US009995046B2

(12) United States Patent
Morton

(10) Patent No.: US 9,995,046 B2
(45) Date of Patent: Jun. 12, 2018

(54) BUCKET SCOOP AND CLEANER/SCRAPER

(71) Applicant: Buddy Tools, LLC, Sulphur Springs, OH (US)

(72) Inventor: Ronald J. Morton, Sulphur Springs, OH (US)

(73) Assignee: BUDDY TOOLS, LLC, Sulphur Springs, OH (US)

( * ) Notice: Subject to any disclaimer, the term of this patent is extended or adjusted under 35 U.S.C. 154(b) by 404 days.

(21) Appl. No.: 14/636,553

(22) Filed: Mar. 3, 2015

(65) Prior Publication Data

US 2015/0252575 A1 Sep. 10, 2015

Related U.S. Application Data

(60) Provisional application No. 61/947,666, filed on Mar. 4, 2014.

(51) Int. Cl.
*E04F 21/16* (2006.01)
*B08B 1/00* (2006.01)
(Continued)

(52) U.S. Cl.
CPC ..... *E04F 21/16* (2013.01); *B08B 1/005* (2013.01); *E04F 21/161* (2013.01);
(Continued)

(58) Field of Classification Search
CPC ..... A47L 13/02; A47L 13/022; A47L 13/08; A47L 17/06; A47J 43/288; B08B 1/005;
(Continued)

(56) References Cited

U.S. PATENT DOCUMENTS 338,449 A * 3/1886 Teller ..... A47J 43/283 294/7
1,325,540 A * 12/1919 Spahr ..... A47L 13/08 15/236.05

(Continued)

FOREIGN PATENT DOCUMENTS

DE 2019472 * 11/1971
DE 2349730 * 4/1975
GB 140904 * 4/1920

OTHER PUBLICATIONS

Wallboard Tool Co., Inc., Wallboard Tools Tuff Grip Bucket Scoop, dated Feb. 19, 2014, Catalog #111577, http://www.all-wall.com/Categories/Mud-Mixing-Tools/Tuff-Grip-Bucket-Scoop.html.

(Continued)

*Primary Examiner* — Mark Spisich
(74) *Attorney, Agent, or Firm* — Renner Otto Boisselle and Sklar

(57) ABSTRACT

The present disclosure provides a drywall tool including a scraping portion having an outwardly curved front portion extending between parallel side edge portions and a support member joined to the scraping portion by at least one fillet. The scraping portion may also be flexible to conform to the inner wall and resilient enough to prevent bending of the scraping portion around hardened putty or other materials attached to the inner wall of the bucket. The fillet may also provide a smooth connection to facilitate cleaning of the drywall tool.

20 Claims, 6 Drawing Sheets

(51) Int. Cl.
*A47L 13/02* (2006.01)
*A47L 13/022* (2006.01)
*E04F 21/165* (2006.01)
*A47L 17/06* (2006.01)

(52) U.S. Cl.
CPC ..... *E04F 21/165* (2013.01); *E04F 21/1652* (2013.01); *A47L 13/02* (2013.01); *A47L 13/022* (2013.01); *A47L 17/06* (2013.01)

(58) Field of Classification Search
CPC ..... E04F 21/06; E04F 21/16; E04F 21/161; E04F 21/28; E04F 21/32
USPC ..... 15/236.01, 236.05–236.09, 235.4, 235.7, 15/245.1; 30/169; 294/176, 180; 425/458; D8/45; D32/46, 49
See application file for complete search history.

(56) References Cited

U.S. PATENT DOCUMENTS 1,369,762 A * 2/1921 Curtiss ..... E04F 21/06 15/235.4
1,401,457 A * 12/1921 Beuckmann ..... A47L 13/08 15/245
1,434,744 A * 11/1922 Hibbler ..... A47L 13/08 15/236.05
1,460,007 A * 6/1923 Williams ..... A47J 43/281 15/236.07
1,647,751 A * 11/1927 Schacht ..... A47L 13/08 15/245
1,898,690 A * 2/1933 Schacht ..... A47L 13/08 15/143.1
1,919,865 A * 7/1933 Schacht ..... A47L 13/08 15/245
2,065,886 A * 12/1936 Clift ..... A47L 13/08 15/236.07
2,291,015 A * 7/1942 Anderson ..... B44D 3/162 15/236.05
2,294,096 A * 8/1942 Rice ..... A47G 21/005 141/110
2,630,591 A * 3/1953 Smith ..... A47J 43/282 15/105
2,900,656 A * 8/1959 Tupper ..... A47J 43/288 15/105
3,092,411 A * 6/1963 Hardy ..... A47J 43/288 294/7
D241,498 S * 9/1976 Smith ..... D32/49
4,355,432 A * 10/1982 Storm, Jr. ..... A47G 21/04 15/236.07
4,919,604 A 4/1990 Wilson
5,008,970 A * 4/1991 Tsai ..... A47L 13/022 15/143.1
5,095,573 A * 3/1992 Henke ..... E04F 21/00 15/105
5,675,860 A * 10/1997 Campbell ..... E04F 21/165 15/235.7
5,875,515 A * 3/1999 Dallas ..... A47J 43/288 15/236.01
8,321,989 B1 * 12/2012 McClanahan ..... B44D 3/162 15/236.01
2004/0164569 A1 * 8/2004 Grundler ..... A47J 43/288 294/7
2014/0070555 A1 * 3/2014 Rose ..... A47J 43/288 294/7

OTHER PUBLICATIONS

WallTools, Advance Cyclone Power Mixer and Pail Scoop Combo, dated Feb. 19, 2014, (ADV-CYC-38406) http://www.walltools.com/advance-cyclone-power-mixer-drywall-mud-mixer.html.
All-Wall Equipment Co., Inc., Corner Pro Flexible Rubber Drywall Coving Knife, dated Feb. 19, 2014, http: www.all-wall.com/Catorgories/Corner-Trowels/CornerPro-Drywall-Bat-Knife.html, Catalog No. 5923.
Dr. Oethker Dough Scraper, dated Feb. 19, 2014, http://www.breadtopia.com/store/newoetker-dough-scraper.html, Rusch Advertising Design.

* cited by examiner

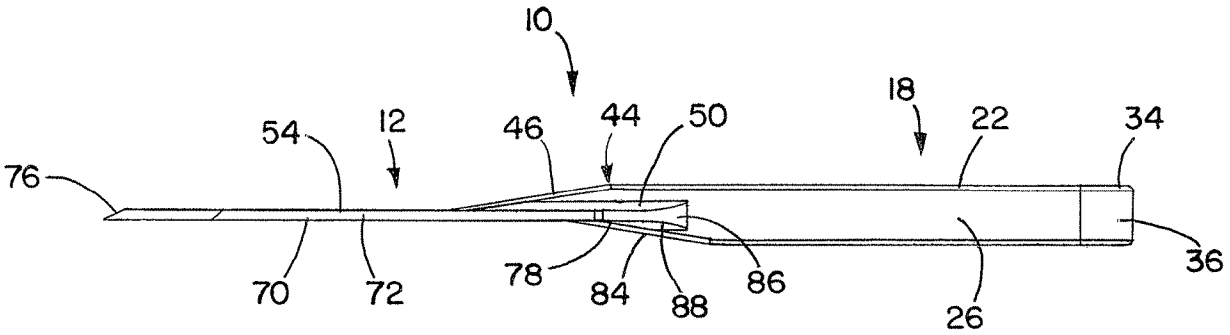
FIG. 4
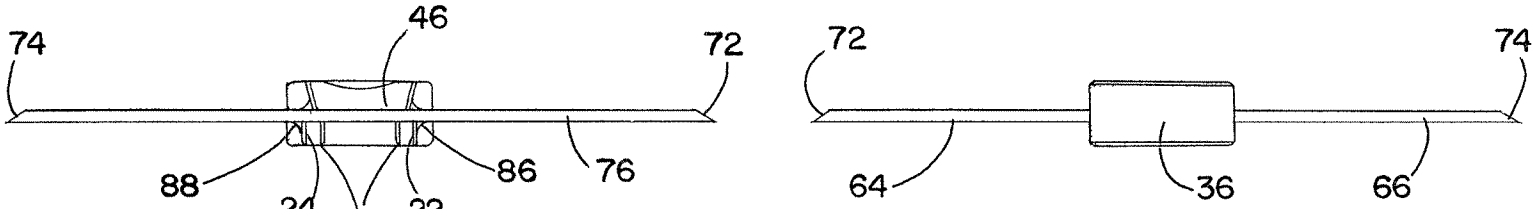
FIG. 5
FIG. 6

BUCKET SCOOP AND CLEANER/SCRAPER

RELATED APPLICATIONS

This application claims the benefit of U.S. Provisional Application No. 61/947,666 filed Mar. 4, 2014, which is all hereby incorporated herein by reference.

FIELD OF INVENTION

The present invention relates generally to scraping tools, and more particularly to a scraper tool for scraping drywall joint compound.

BACKGROUND

Joint knives and spackle knives are used to spread joint compound, commonly called "mud" or "putty." Putty can be spread over various areas of a sheetrock wall to cover imperfections, such as screw indents, seams, holes, or to otherwise smooth over the wall. The joint and spackle knives have a handle and a blade portion. The blades are typically flexible or stiff with a flat front end for scraping joint compound from or applying joint compound to a flat sheetrock wall.

SUMMARY OF INVENTION

The present disclosure provides a drywall tool including a scraping portion having an outwardly curved front portion extending between parallel side edge portions and a support member joined to the scraping portion by at least one fillet. The scraping portion may be flexible to conform to the inner wall and resilient enough to prevent bending of the scraping portion around hardened putty or other materials attached to an inner wall of a bucket. The fillet may provide a smooth connection to facilitate cleaning of the drywall tool.

According to one aspect of the invention, a drywall tool, comprises a generally planar scraping portion having parallel side edge portions, an outwardly curved front portion extending between the side edge portions, and a back portion extending between the side edge portions, a handle extending rearwardly from the back portion, and a first support member extending along a top portion of the generally planar scraping portion and having a fillet joining each side of the first support member to the generally planar scraping portion.

The drywall tool may further comprise a second support member extending along a bottom portion opposite the first support member, wherein the second support member extends less than 10% of a length of the scraping portion.

The first support member may extend from the back portion towards the front portion a distance less than 50% of a length of the scraping portion.

The first support member may extend less than a length of one or more of the side edges.

The second support member may extend less than a length of the first support member.

The generally planar scraping portion may have a Young's Modulus greater than 0.4 GPa.

The handle may have an axis that is parallel to the side portions.

The generally planar scraping portion and the handle may be made of the same material.

The generally planar scraping portion and the handle may be one-piece.

The generally planar scraping portion may include a beveled front edge.

The side edge may have a length greater than 30% of a length of the generally planar scraping portion.

The parallel side edges may be beveled.

The handle may include a cavity extending through the handle along a cavity axis perpendicular to the generally planar scraping portion.

The cavity may extend substantially along a length of the handle.

According to another aspect of the invention, a drywall tool, comprises a generally planar scraping portion having a first end, a second end, and a first longitudinal axis extending from the first end to the second end, the generally planar scraping portion including a top scraping portion facing a first direction, a bottom scraping portion facing a second direction opposite the first direction, and a side edge extending axially from the first end toward the second end offset from the first longitudinal axis, and a handle having a first handle end and a second handle end, wherein the handle is integrally formed with the generally planar scraping portion and extends along a second longitudinal axis from the first end of the scraping portion toward the first handle end.

The generally planar scraping portion may include a curved front edge.

The side edge may be parallel to the first longitudinal axis.

The generally planar scraping portion may include a second side edge opposite the first.

The first longitudinal axis and the second longitudinal axis may be coaxial.

The drywall tool may further comprise at least one back fillet connecting the generally planar scraping portion to the handle.

The foregoing and other features of the invention are hereinafter described in greater detail with reference to the accompanying drawings.

BRIEF DESCRIPTION OF THE DRAWINGS

FIG. 4 is a side view of the exemplary drywall tool with a coplanar top support member, bottom support member, and first handle section wall;

FIG. 5 is a front view of the exemplary drywall tool;

FIG. 6 is a back view of the exemplary drywall tool;

DETAILED DESCRIPTION

Figure 1:
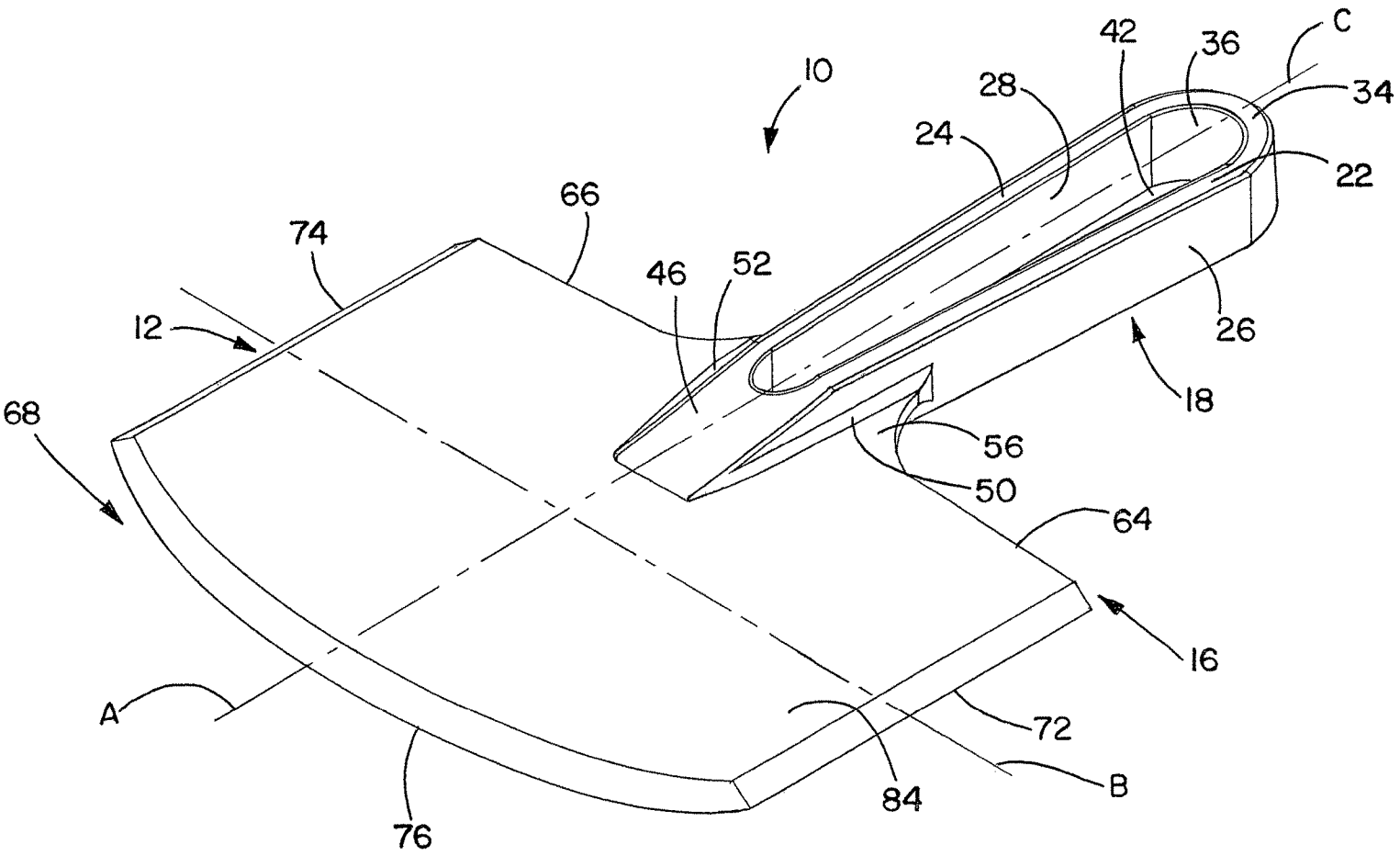
FIG. 1 is a perspective view of an exemplary drywall tool according to the disclosure.
Figure 2:
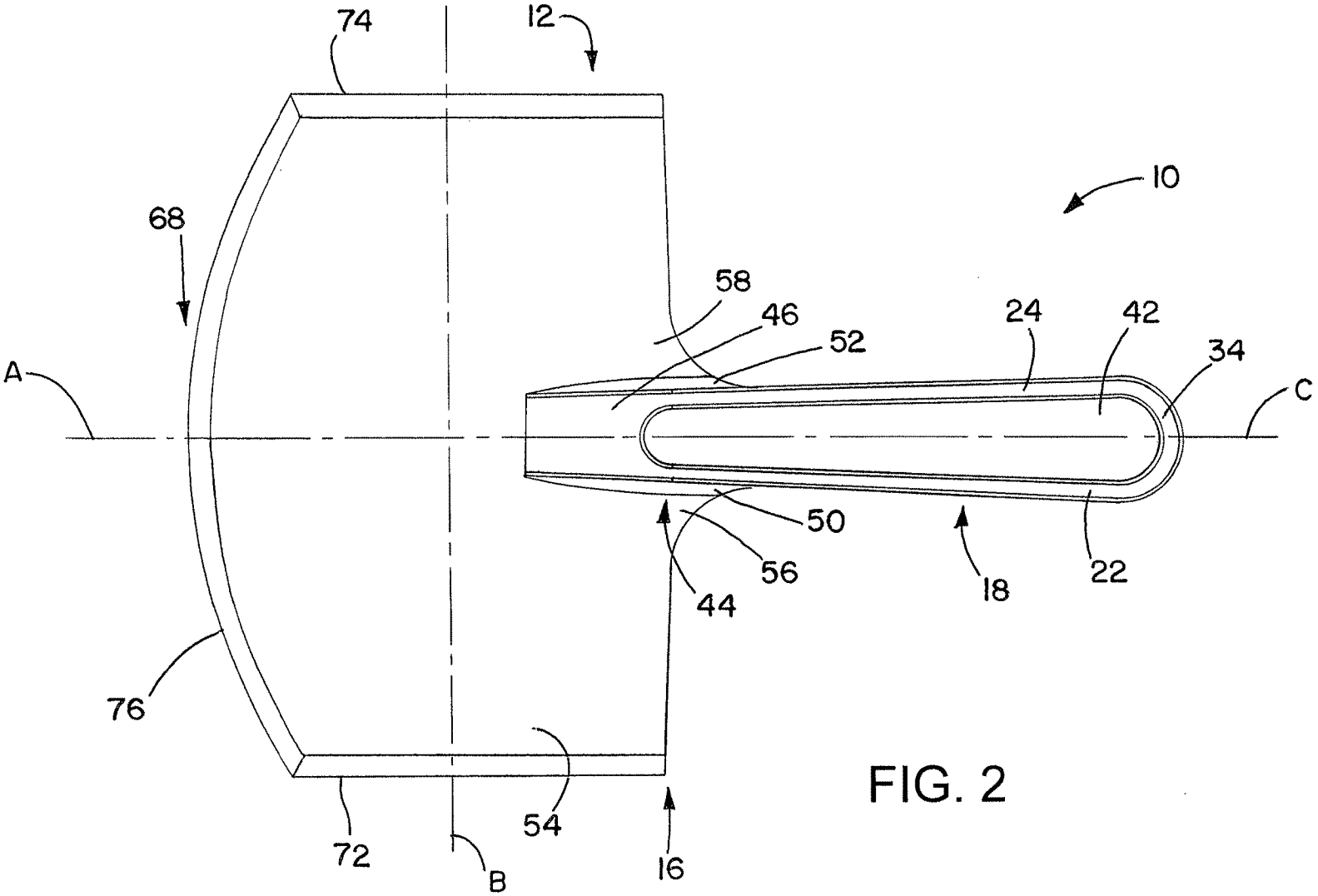
FIG. 2 is a top view of the exemplary drywall tool.

The principles of the present disclosure have particular application to drywall scraping tools and thus will be described below chiefly in this context. It will of course be appreciated, and also understood, that the principles of the disclosure may be useful in other applications where particulate is scraped or cleaned from a surface. Such other applications include, cleaning paint, asphalt coating, food materials such as pie filling, etc. or any type of thick materials from a surface, for example, an inner wall of a bucket.

FIGS. 1-6 illustrate a drywall tool 10 including a scraping portion 12 and a handle 18. The handle 18 may have a first handle end (hereinafter referred to as "rounded handle end section 34") and a second handle end (hereinafter referred to as "handle end 44"), wherein the handle extends along a longitudinal axis C from a first end 16 of the scraping portion 12 toward the rounded handle end section 34. For example, the handle 18 may include the rounded handle end section 34 and the handle end 44 opposite the rounded handle end section 34, and the handle 18 may extend along an axis offset or nonparallel to the longitudinal axis A. Alternatively, the handle 18 may extend along or parallel to the longitudinal axis A, which may be coaxial with the longitudinal axis C. Alternatively, the handle 18 may extend from the scraping portion 12 along longitudinal axis C at an angle nonparallel with the longitudinal axis A.

The scraping portion 12 may be generally planar and have parallel side edge portions 72, 74 (hereinafter referred to as "first side edge 72" and "second side edge 74"), an outwardly curved front portion (hereinafter referred to as a "front edge 76") extending between the side edges 72, 74, and a back portion 64, 66 (hereinafter referred to as "first back edge 64" and "second back edge 66") extending between the side edges 72, 74. The handle 18 may extend rearwardly from the back edges 64, 66. A first support member (hereinafter referred to as "top support member 46") may extend along a top portion (hereinafter referred to as "top scraping portion 54") of the generally planar scraping portion 12 and having a fillet 50, 52 (hereinafter referred to as "top fillet 50" and "top fillet 52") joining each side of the top support member 46 to the generally planar scraping portion 12.

The handle 18, which may be integrally formed with the scraping portion 12 or coupled thereto in any suitable manner, may extend rearwardly from the back edges 64, 66 of the scraping portion 12 and include a first handle section 22 and a second handle section 24. The second hand section 24 may be opposite the first handle section 22 and connected to the first handle section by a rounded handle section 34. The first and second handle sections 22 and 24 and the rounded handle section 34 may be formed as one-piece, such as by being molded from nylon, or coupled together in any suitable manner. The first handle section 22 and second handle section 24 may extend along a plane defined by the scraping portion 12.

The first and second handle sections 22 and 24 each include a section wall 26 and 28, respectively, to provide a surface for a user to grip the handle 18. The first and second section walls 26 and 28 may extend in a direction perpendicular to the scraping portion 12 to define a plane perpendicular to the plane defined by the scraping portion 12. The first handle section 22 and second handle section 24 may extend at an oblique angle from the scraping portion 12. For example, the first handle section 22 may extend at an 85 degree angle from the scraping portion 12. Additionally, the second handle section 24 may extend at an 85 degree angle from the scraping portion 12. The first handle section 22 may be at a 10 degree angle from parallel with the second handle section 24. In some embodiments the first handle section 22 and the second handle section 24 may be parallel (not shown) to one another or off-set at an angle from one another. In other embodiments, the first handle section 22 and the second handle section 24 may extend at less than an 85 degree angle from the scraping portion 12. For example, first handle section 22 and the second handle section 24 may extend at a 60 degree angle from the scraping portion 12.

The rounded handle end section 34 may be a u-shape and connect at one side to the first handle section 22 and at the other side to the second handle section 24. The rounded handle end section 34 may include a rounded handle end section wall 36, which may align with the first handle section wall 26.

The rounded handle end section 34 may be configured to support the first handle section 22 and the second handle section 24, which may allow a user to grip the handle 18 an apply more force than possible with non-joined handle section. This rounded handle end section 34 may allow a user to apply more force against a bucket or other object through the handle 18 to the scraping portion 12 because the rounded handle end section 34 may inhibit bending of the first handle section 22 and the second handle section 24.

The rounded handle end section 34 may connect seamlessly to the first handle section wall 26 and the second handle section wall 28 to facilitate removal of a working material that may accumulate on the handle 18 during use. For example, joint compound may splash onto or rub against the handle 18 while the drywall tool 10 is being used to scrape joint compound from the inside of a bucket.

The handle 18 may include a handle cavity 42 that may be defined as the volume between the first handle end, second handle end, rounded handle end and end attached to the scraping portion The handle cavity 42 may extend through the handle 18 along a cavity axis perpendicular to longitudinal axis C, thereby allowing the handle to be hung, for example on a hook. The handle cavity 42 may extend along the handle coaxially with the longitudinal axis C and may extend through the handle perpendicular to longitudinal axis C and axis B to allow a hook to fit through the handle cavity 42. The handle cavity reduces the amount of material used for the handle and allows the handle 18 to be lighter. For example, the handle 18 may be made from a mold filled with nylon, thus, less nylon is needed to make the handle 18 with the handle cavity 42.

Specifically referring to FIGS. 1, 2, 4, and 5, the top support member 46 may extend along the scraping portion 12. The top support member 46 may extend along a top scraping portion 54 from the handle end 44 and along the top scraping portion 54 toward a second end 68. The top support member 46 may have a length extending parallel to longitudinal axis A and a width extending parallel to axis B perpendicular to longitudinal axis A. For example, the length and width of the top support member 46 may extend along the top scraping portion 54 and the length of the top support member 46 may extend to the handle 18.

Figure 7:
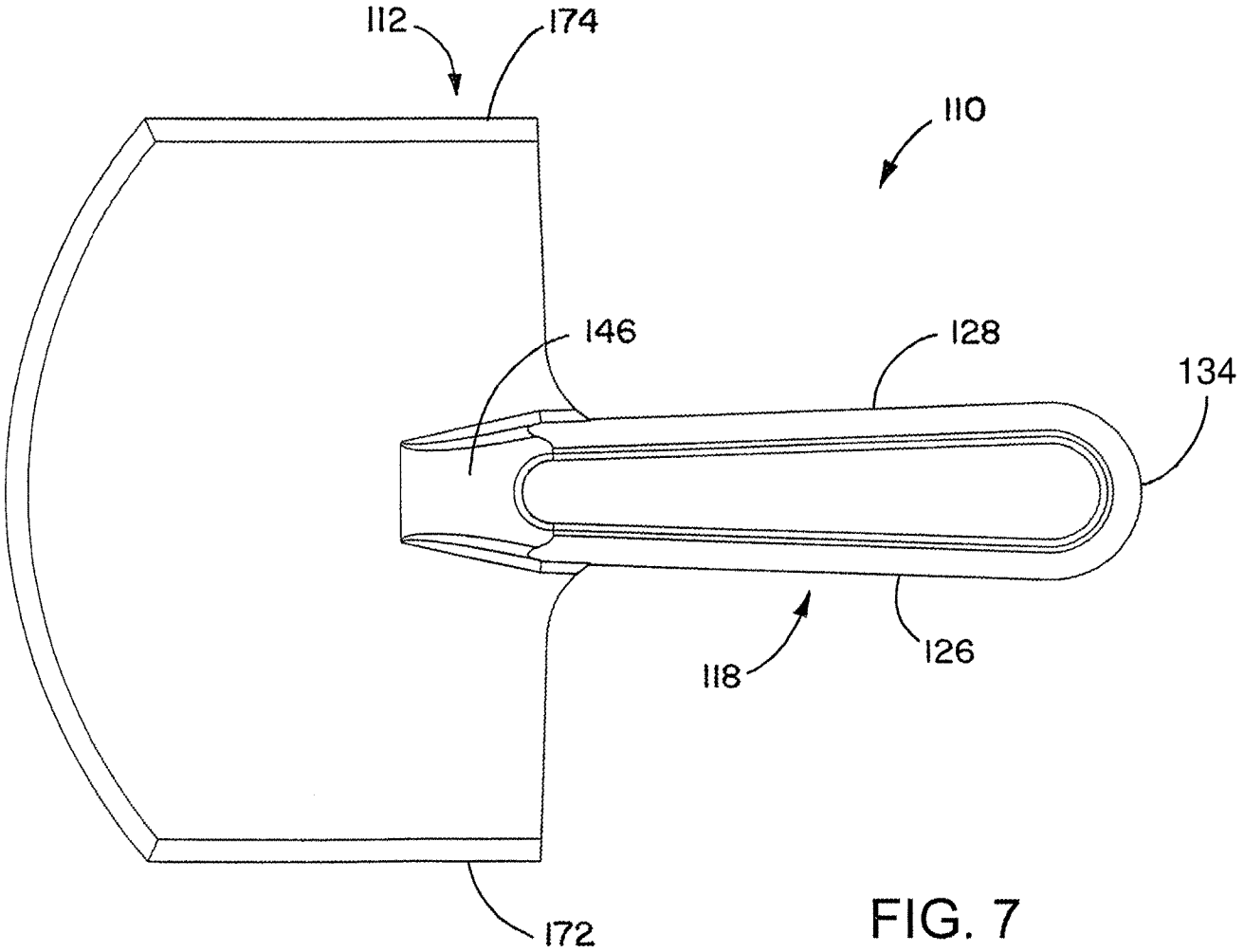
FIG. 7 is a top view of another exemplary drywall tool.

In one embodiment the width of the top support member 46 is less than a width of the scraping portion between the side portions. In an embodiment, the width of the support member 46 is less than 50% of the width of the scraping portion 46. In another embodiment, the width of the support member 46 is less than 15% of the width of the scraping portion 12. The length of the top support member 46 may be less than 50% a distance between the first end 16 and the second end 68. In other embodiments the top support member 46 may have a length nonparallel with the longitudinal axis A, a width nonparallel with the axis B, a width nonparallel with the first edge 72 or second edge 74 (as shown in FIG. 7), or a length up to 100% a distance between the first end 16 and the second end 68.

The top support member 46 may decline from a top of the top support member 46 to the scraping portion 12. For example, the top support member 46 may be sloped at an angle from the top scraping portion 54 to the handle end 44. The sloping of the top support member 46 may form an obtuse angle with the top scraping portion 54 and allow rinsing of the drywall tool 10 to more easily clean the drywall tool 10.

The top support member 46 increases strength and rigidity of the scraping portion 12 in a direction from or toward the top support member 46. The top support member 46 strengthens the connection between the scraping portion 12 and the handle 18, thereby minimizing the likelihood of breakage.

The top support member 46 may extend toward the front edge 76 a distance less than a length of the first side edge 72 or the second side edge 74. For example, the top support member 46 may extend a distance that is only 40% a length of either the first side edge 72 or the second side edge 74. Reducing the length of the top support member 46 allows a reduction in materials to build the tool 10, facilitates easier cleaning of the scraping portion, and allows consistent flexibility throughout the length of the scraping portion 12. Alternatively, the top support member 46 may extend toward the front edge 76 a distance less than 40% or greater than 40% a length of either the first side edge 72 or the second side edge 74.

Top fillets 50, 52 may further join the top support member 46 to the scraping portion 12. Thus, the strength of the connection between the top support member 46 and the scraping portion 12 may be increased. Further, the top fillets 50, 52 may facilitate cleaning of the drywall tool 10. For example, after use the joint compound may remain on parts of the drywall tool, particularly corners (not shown). Top fillets 50, 52 may smooth-out corners adjacent the top scraping portion 54 to more easily clean the drywall tool 10, particularly adjacent the top support member 46 and the top scraping portion 54.

Referring now to the scraping portion in detail, the scraping portion 12 may include the top scraping portion 54, the first back edge 64, the second back edge 66, the second end 68 opposite the first end 16, a first side edge 72, a second side edge 74, and a front edge 76. The scraping portion 12 may be generally planar and have the first end 16, the second end 68, and a longitudinal axis A extending from the first end 16 to the second end 68.

The top scraping portion 54 may face a first direction. The first direction may be perpendicular to the longitudinal axis A and/or axis B. For example, the top scraping portion 54 may face upward. During use the top scraping portion 54 may face away from an inner wall of a container in which the drywall tool is being used. Alternatively, the top scraping portion 54 may face toward the inner wall during use.

The first back edge 64 and/or the second back edge 66 may be perpendicular to longitudinal axis A and opposite one another about the longitudinal axis A. In some embodiments the first back edge 64 may be nonparallel (not shown) with the second back edge 66. For example, the first back edge 64 may form an obtuse angle (e.g., 92°) with the first side edge 72. In some embodiments the first back edge 64 may be longitudinally spaced apart (not shown) offset along longitudinal Axis B, for example, offset by greater than 0" (e.g., 0.5"). The first back edge 64 may connect to the first handle section wall 26 through a back fillet 56. The second back edge 66 may connect to the second handle section wall 28 through a back fillet 58. The back fillet 56, for example, may have a 1.5" radius about an axis perpendicular to the longitudinal axis A and axis B. The top fillet 50 may extend between the back fillet 56 and the first handle section wall 26 and/or the top fillet 52 may extend between the back fillet 58 and the second handle section wall 28 to create a smooth transition to increase strength and facilitate cleaning of the drywall tool 10.

In some embodiments the back fillet 56 and/or the back fillet 58 may have a radius of 1.5", less than 1.5", or greater than 1.5". For example, the back fillet 56 may have a radius of 10" or greater. In another example, the back fillet may have a radius of 0.1" or less. In other embodiments the first back edge 64 may directly connect to the first handle section wall 26 and/or the second back edge 66 may directly connect to the second handle section wall 28.

The back fillet 56 and/or the back fillet 58 reinforces the connection between the scraping portion 12 and the handle 18 to increase the amount of force that may be applied to the scraping portion 12 through the handle 18 during use. The back fillet 56 and/or the back fillet 58 facilitate cleaning of the drywall tool 10.

The first side edge 72 and/or side edge 74 may extend axially from the first end 16 toward the second end 68 offset from the longitudinal axis A. For example, the first side edge 72 and/or the second side edge 74 may be parallel with and off-set from the longitudinal axis A. This orientation side edge 72 facilitates aligning the first side edge 72 and/or the second side edge 74 against an inner wall or a container to scrape material from the inner wall of the container. For example, a user may hold the handle 18 and easily press the first side edge 72 against an inner wall of a bucket to remove joint compound accumulated on the inner wall. In some embodiments the first side edge 72 and/or the second side edge 74 may be beveled. The beveling enhances scraping of an inner wall of a container by allowing the first beveled side edge to contact joint compound contacting the inner wall at a point of contact closer to the inner wall. In other embodiments the first side edge 72 and/or may be flat or another suitable shape.

The first side edge 72 and/or the second side edge 74 may extend greater than 30% a distance between the first end 16 and the second end 68. For example, the first side edge 72 may remain parallel to the longitudinal axis A for a distance greater than 30% of the distance between the first end 16 and the second end 68. Elongating the first side edge 72 and/or the second side edge 74 allows a greater surface area for the first side edge 72 and/or the second side edge 74 to align with an inner wall to scrape joint compound or other particulate therefrom. Alternatively, the first side edge 72 and/or the second side edge 74 may extend equal to or less than 30% the distance between the first end 16 and the second end 68.

The front edge 76 may be opposite the first back edge 64 and/or the second back edge 66. Also, the front edge 76 may extend from the first side edge 72 to the second side edge 74. In some embodiments the front edge 76 is rounded to allow the front edge 76 to align with the inner wall of a rounded container. For example, the front edge 76 may be aligned with the inner wall of a cylindrical bucket. Once aligned the front edge 76 may be pressed firmly against the inner wall and slid along the inner wall towards one end of the cylindrical bucket or the other. The sliding of the front edge 76 against the inner wall may cause particulate, such as joint compound, on the inner wall to be removed from the inner wall.

In some embodiments the front edge 76 may be beveled. In other embodiments the front edge 76 may be flat or another suitable shape.

Figure 3:
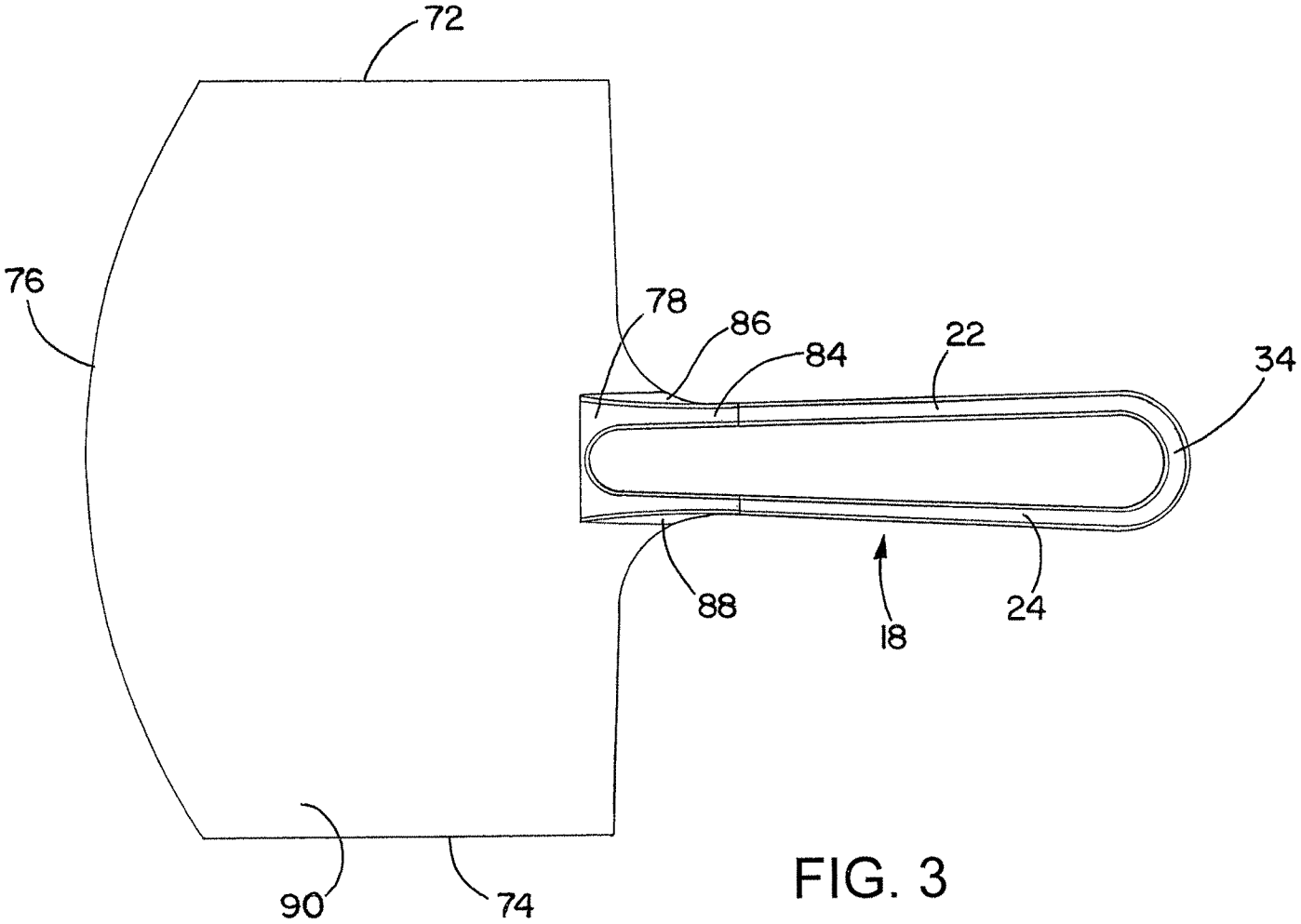
FIG. 3 is a bottom view of the exemplary drywall tool.

Turning to FIGS. 3, 4, and 5 the drywall tool 10 may further include a bottom support member 78 and a bottom scraping portion 90.

The bottom scraping portion 90 may face a second direction. For example, the second direction may be opposite the top scraping portion 54. The second direction may be perpendicular to the longitudinal axis A and axis B. During use the bottom scraping portion 90 may face toward an inner wall of a container in which the drywall tool 10 is being used. Alternatively, the bottom scraping portion 90 may face away from the inner wall during use.

The bottom support member 78 may extend from the second handle end 44 and along the bottom scraping portion 90 toward the second end 68. For example, the bottom support member 78 may extend from the handle 18 less than a length of the top support member 46 toward the second end 68. In some embodiments, the bottom support member 78 may extend generally along the longitudinal axis A less than 50% the length of the top support member 46. In other embodiments, the bottom support member 78 may extend less than 10% of the length of the top. This reduces the materials required to make the drywall tool 10, and increases flexibility of the scraping portion 12 bending in the direction of the bottom support member 78. Also, the reduced materials and design of the bottom support member 78 facilitate cleaning of the bottom scraping portion 90.

The bottom support member 78 may have a length parallel to longitudinal axis A and a width parallel to axis B. For example, the length and width of the bottom support member 78 may extend along the bottom scraping portion 90 and the length of the bottom support member 78 may extend to the handle 18.

The width of the bottom support member 78 is less than a width of the scraping portion 12 between the side edges. In an embodiment, the width of the bottom support member 78 is less than 50% of the width of the scraping portion 12. In another embodiment, the width of the bottom support member 78 is less than 15% of the width of the scraping portion 12. For example, the width may be flush with the handle end 44. The length of the bottom support member 78 may be less than 5% a distance between the first end and the second end. In other embodiments the bottom support member 78 may have a length nonparallel with the longitudinal axis A, a width nonparallel with the axis B, or a length up to 100% a distance between the first end and the second end.

The bottom support member 78 may decline from a bottom of bottom support member 78 to the scraping portion 12. For example, the bottom support member 78 may be sloped at an angle from the bottom scraping portion 90 to the handle end 44. Also, the sloping of the bottom support member 78 may be flush with a sloped handle portion 46 and may form an obtuse angle with the bottom scraping portion 90, thereby enabling the drywall tool 10 to be easily cleaned.

The bottom support member 78 reduces flexibility and increases strength of the scraping portion 12 bending in the direction of the bottom support member 78. Further, the bottom support member 78 strengthens the connection between the scraping portion 12 and the handle 18, which enables a greater force to be applied to the handle 18.

The sloped handle portion 46 may extend from the handle 18 toward the bottom scraping portion 90. For example, the sloped handle portion 46 may be flush with the bottom member support 78 to facilitate easier cleaning and manufacture of the drywall tool 10. In some embodiments the sloped handle portion 46 is not flush with the bottom member support 78. In other embodiments the handle 18 does not include a sloped handle portion 46.

Bottom fillets 86, 88 may further join the bottom support member 78 to the scraping portion 12. Thus, the strength of the connection between the bottom support member 78 and the scraping portion 12 may be increased. Also, the bottom fillets 86, 88 may facilitate cleaning of the drywall tool 10. For example, after use joint compound may remain on parts of the drywall tool, particularly corners (not shown). Top fillets 86, 88 may smooth-out corners adjacent the bottom scraping portion 90 to more easily clean the drywall tool 10, particularly adjacent the bottom support member 78 and the bottom scraping portion 90.

The scraping portion 12 may be made of the same material as the rest of the drywall tool 10, which may include the handle 18, top support member 46, and bottom support member 78. For example, the entire drywall tool 10 may be made of nylon. Alternatively, the drywall tool 10 may be made from different materials. For example, the scraping portion 12 may be made from a stronger material than the handle 18.

The scraping portion 12, handle 18, top support member 46, and bottom support member 78 may be one-piece. In some embodiments the drywall tool 10 may be molded from any suitable material, such as nylon, a thermoplastic material or a thermoset material. For example, the drywall tool 10 may be have a Young's Modulus of equal to or greater than 0.4 GPa, 0.6 GPa, 0.8 GPa, or 1 GPa, and equal to or less than 5 GPa, 4 GPa, 3 GPa, 2 GPa. Such materials allow the scraping portion 12 to bend to the shape of the inside of a bucket without breaking or deforming, and provide enough strength to effectively scrape joint compound from the inside of the bucket. In other embodiments the drywall tool 10 may be made of any suitable material, such as metal. For Example, the dry wall tool may have a Young's Modulus of equal to or greater than 10 GPa, 20 GPa, 40 GPa or 60 Gpa. Alternatively, the drywall tool 10 may be made from separate components attached together using any suitable connecting means.

The present disclosure discloses a drywall tool 10 that requires less material to form the handle 18 and the scraping portion 12 in one-piece and with sufficient strength to scrape particulate from a bucket, a building wall, or another object.

Figure 8:
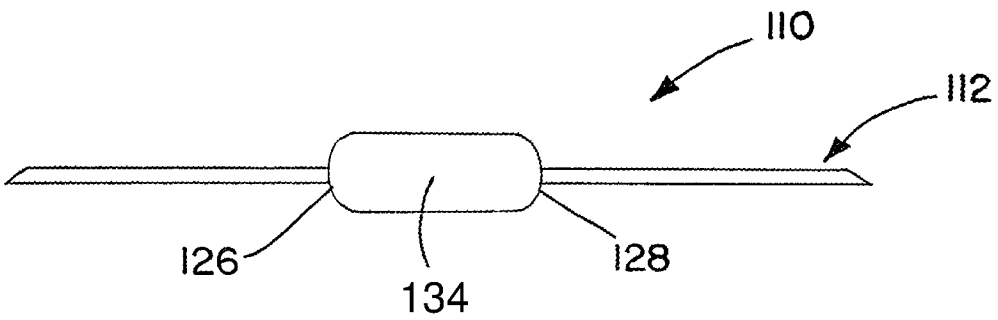
FIG. 8 is a back view of the other exemplary drywall tool.

Turning now to FIGS. 7 and 8, an exemplary embodiment of the dry wall tool is shown at 110. The dry wall tool 110 is substantially the same as the above-referenced dry wall tool 10, and consequently the same reference numerals but indexed by 100 are used to denote structures corresponding to similar structures in the dry wall tool 110. In addition, the foregoing description of the dry wall tool 10 is equally applicable to the dry wall tool 110 except as noted below. Moreover, it will be appreciated upon reading and understanding the specification that aspects of the dry wall tools 10, 110 may be substituted for one another or used in conjunction with one another where applicable.

The dry wall tool 110 includes a scraping portion 112 and a handle 118. The handle may include a first handle section wall 126, a second handle section wall 128 and a rounded handle end section 134. The outer surface of the any one of or all of the first handle section wall 126, the second handle section wall 128 and the rounded handle end section 134 may be rounded along the outer surface between the top and bottom of the handle 118. The rounding of the outer surface provides easier gripping and more comfortable gripping of the handle 118 while using the dry wall tool 110.

The dry wall tool 110 includes a top support member 146. The top support member 146 may have a width that angles inwards along a length of the top support member 146. In one embodiment the width of the top support member 146 is nonparallel with the first edge 172 or second edge 174. This configuration enables the top support member 146 to require less material to construct. This configuration also enables the handle 118 to be wider or include the first handle section wall 126, the second handle section wall 128 and the rounded handle end section 134 with rounded outer surfaces, while still providing adequate support and using minimal materials.

Although the invention has been shown and described with respect to a certain embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

What is claimed is:

1. A drywall tool, comprising:

a generally planar scraping portion having parallel side edge portions, an outwardly curved front portion extending between the side edge portions, and a back portion extending between the side edge portions;

a handle extending rearwardly from the back portion;

a first support member extending from an end of the handle along a top portion of the generally planar scraping portion and having an elongated top fillet joining each side of the first support member to the top portion of the generally planar scraping portion; and a back fillet between the back portion of the generally planar scraping portion and each respective side of the handle, wherein ends of the back fillets and ends of the respective top fillets meet along the respective side of the handle.

2. The drywall tool according to claim 1, further comprising:

a second support member extending along a bottom portion of the generally planar scraping portion opposite the first support member, wherein the second support member extends less than 10% of a length of the scraping portion.

3. The drywall tool according to claim 2, wherein the first support member extends from the back portion towards the front portion a distance less than 50% of a length of the scraping portion.

4. The drywall tool according to claim 2, wherein the first support member extends less than a length of one or more of the side edge portions.

5. The drywall tool according to claim 2, wherein the second support member extends less than a length of the first support member.

6. The drywall tool according to claim 2, further comprising:

wherein the second support member has an elongated bottom fillet joining each side of the second support member to the bottom portion of the generally planar scraping portion, wherein ends of the back fillets and ends of the respective bottom fillets meet along the respective side of the handle.

7. The drywall tool according to claim 1, wherein the generally planar scraping portion has a Young's Modulus greater than 0.4 GPa.

8. The drywall tool according to claim 1, wherein the handle has an axis that is parallel to the side portions.

9. The drywall tool according to claim 1, wherein the generally planar scraping portion and the handle are made of the same material.

10. The drywall tool according to claim 9, wherein the generally planar scraping portion and the handle are one-piece.

11. The drywall tool according to claim 1, wherein the generally planar scraping portion includes a beveled front edge.

12. The drywall tool according to claim 1, wherein each of the parallel side edge portions has a length greater than 30% of a length of the generally planar scraping portion.

13. The drywall tool according to claim 1, wherein the handle includes a cavity extending through the handle along a cavity axis perpendicular to the generally planar scraping portion.

14. A drywall tool, comprising:

a generally planar scraping portion having parallel side edge portions, an outwardly curved front portion extending between the side edge portions, and a back portion extending between the side edge portions;

a handle extending rearwardly from the back portion;

a first support member extending from an end of the handle along a top portion of the generally planar scraping portion and having an elongated top fillet joining each side of the first support member to the top portion of the generally planar scraping portion; and a back fillet between the back portion of the generally planar scraping portion and each respective side of the handle, wherein ends of the back fillets and ends of the respective top fillets meet along the respective side of the handle;

wherein the handle includes a cavity extending through the handle along a cavity axis perpendicular to the generally planar scraping portion; and wherein the cavity extends substantially along a length of the handle.

15. A drywall tool, comprising:

a generally planar scraping portion having a first end, a second end, and a first longitudinal axis extending from the first end to the second end, the generally planar scraping portion including:

a top scraping portion facing a first direction;

a bottom scraping portion facing a second direction opposite the first direction; and a side edge extending axially from the first end toward the second end offset from the first longitudinal axis, wherein the first longitudinal axis is parallel to the side edge and is disposed substantially at a mid-point of the first end of the generally planar scraping portion and a mid-point of the second end of the generally planar scraping portion; and a handle having a first handle end and a second handle end, wherein the handle and the generally planar scraping portion are one-piece, and the handle extends along a second longitudinal axis from the first end of the scraping portion toward the first handle end, the second longitudinal axis being coaxial with the first longitudinal axis;

wherein the handle includes a cavity extending through the handle along a cavity axis perpendicular to the generally planar scraping portion, and wherein the cavity extends continuously substantially along an entire length of the handle along the second longitudinal axis;

wherein the handle has a thickness along the cavity axis that is greater than a thickness of any other portion of the drywall tool; and wherein the handle includes a first handle section and a second handle section opposite the first handle section to together define at least a portion of the cavity, and wherein each handle section has a thickness along the cavity axis that is greater than a width of the corresponding handle section perpendicular to the cavity axis.

16. The drywall tool according to claim 15, wherein the generally planar scraping portion includes a curved front edge.

17. The drywall tool according to claim 15, wherein the side edge is a first side edge, and the generally planar scraping portion includes a second side edge opposite the first side edge relative to the first longitudinal axis.

18. The drywall tool according to claim 15, further comprising:

at least one back fillet connecting the generally planar scraping portion to the handle; and a first support member extending from the second handle end along the top scraping portion and having an elongated top fillet joining each side of the first support member to the top scraping portion;

wherein the at least one back fillet is between the first end of the generally planar scraping portion and a respective side of the handle, wherein an end of the at least one back fillet and an end of a respective top fillet meet along the respective side of the handle.

19. The drywall tool according to claim 18, wherein the at least one back fillet is a pair of back fillets, and wherein ends of the back fillets and ends of the respective top fillet meet along the respective side of the handle.

20. The drywall tool according to claim 15, wherein the entire drywall tool is one-piece.

* * * * *